United States Patent [19]

Harandi et al.

[11] Patent Number: 5,034,565

[45] Date of Patent: Jul. 23, 1991

[54] PRODUCTION OF GASOLINE FROM LIGHT OLEFINS IN A FLUIDIZED CATALYST REACTOR SYSTEM

[75] Inventors: Mohsen N. Harandi, Lawrenceville; Hartley Owen, Belle Mead; Samuel A. Tabak, Wenonah, all of N.J.

[73] Assignee: Mobil Oil Corporation, New York, N.Y.

[21] Appl. No.: 248,709

[22] Filed: Sep. 26, 1988

[51] Int. Cl.[5] ..... C07C 2/12

[52] U.S. Cl. ..... 585/533; 585/415; 585/519; 585/722; 585/734

[58] Field of Search ..... 585/533, 734, 722, 415, 585/519

[56] References Cited

U.S. PATENT DOCUMENTS

| | | | |
|---|---|---|---|
| 4,504,691 | 3/1985 | Hsia et al. | 585/519 |
| 4,511,747 | 4/1985 | Wright et al. | 585/533 |
| 4,568,786 | 2/1986 | Hsia Chen et al. | 585/533 X |
| 4,746,762 | 5/1988 | Avidan et al. | 585/533 X |
| 4,831,203 | 5/1989 | Owen et al. | 585/533 X |
| 4,831,204 | 5/1989 | Kushnerick et al. | 585/533 X |
| 4,831,205 | 5/1989 | Krambeck et al. | 585/533 X |

*Primary Examiner*—Asok Pal

*Attorney, Agent, or Firm*—Alexander J. McKillop; Charles J. Speciale; L. G. Wise

[57] ABSTRACT

A improved process is provided for upgrading light olefins from hydrocarbon cracking, such as light crackate gas containing ethene, propene and other $C_1$–$C_4$ lower aliphatics. The process comprises the steps of: maintaining an oligomerization reactor containing a fluidized bed of zeolite catalyst particles in a low severity reactor bed at oligomerization temperature conditions by passing hot olefinic gas upwardly through the fluidized catalyst bed under throughput rate conditions sufficient to convert at least 50 wt % of lower olefins to hydrocarbons in the $C_5$–$C_{10}$ range; maintaining turbulent fluidized bed conditions through the fluidized bed by passing fresh ethene-rich feedstream gas upwardly through the fludized catalyst bed and adding thereto sufficient recycled light byproduct gas to maintain a minimum gas velocity; cooling reaction effluent from the conversion zone to provide light gas byproduct and liquid hydrocarbon rection product rich in $C_5$–$C_9$ hydrocarbons; and recycling sufficient light byproduct gas recovered from effluent or maintaining turbuelnt regime gas velocity in the fluidized bed.

13 Claims, 2 Drawing Sheets

PRODUCTION OF GASOLINE FROM LIGHT OLEFINS IN A FLUIDIZED CATALYST REACTOR SYSTEM

Field of the Invention

This invention relates to a technique for integrating an olefins upgrading process for the catalytic conversion of olefinic light gas to liquid hydrocarbons with the processing and separation of light cracking gases.

BACKGROUND OF THE INVENTION

Hydrocarbon mixtures containing significant quantities of light olefins are frequently encountered in petrochemical plants and petroleum refineries. Because of the ease with which olefins react, these streams serve as feedstocks in a variety of hydrocarbon conversion processes. Many olefinic conversion processes require that the olefinic feed be provided in a highly purified condition. However, processes which may utilize the olefinic feedstocks without the need for further separation and purification are highly desirable.

Although the main purpose of fluidized catalytic cracking (FCC) is to convert gas oils to compounds of lower molecular weight in the gasoline and middle distillate boiling ranges, significant quantities of $C_1$–$C_4$ hydrocarbons are also produced. These light hydrocarbon gases are rich in olefins which heretofore have made them prime candidates for conversion to gasoline blending stocks by means of polymerization and/or alkylation. Fractionation of the effluent from the fluid catalytic cracking reactor has been employed to effect an initial separation of this stream. The gaseous overhead from the main fractionator is collected and processed in the FCC gas plant. Here the gases are compressed, contacted with a naphtha stream, scrubbed, where necessary, with an amine solution to remove sulfur and then fractionated to provide, for example, light olefins and isobutane for alkylation, light olefins for polymerization, n-butane for gasoline blending and propane for LPG. Light gases are recovered for use as fuel.

Since alkylation units were more costly to build and operate than polymerization units, olefin polymerization was initially favored as the route for providing blending stocks. Increased gasoline demand and rising octane requirements soon favored the use of alkylation because it provided gasoline blending stocks at a higher yield and with a higher octane rating than the comparable polymerized product. However, catalytic alkylation can present some safety and disposal problems. In addition, feedstock purification is required to prevent catalyst contamination and excess catalyst comsumption. Further, sometimes there is insufficient isobutane available in a refinery to permit all the olefins from the FCC to be catalytically alkylated.

Conversion of olefins to gasoline and/or distillate products is disclosed in U.S. Pat. Nos. 3,960,978 and 4,021,502 (Givens, Plank and Rosinski) wherein gaseous olefins in the range of ethylene to pentene, either alone or in admixture with paraffins are converted into an olefinic gasoline blending stock by contacting the olefins with a catalyst bed made up of ZSM-5 or related zeolite. In U.S. Pat. Nos. 4,150,062 and 4,227,992 Garwood et al disclose the operating conditions for the Mobil Olefin to Gasoline/Distillate (MOGD) process for selective conversion of $C_3$+ olefins.

The phenomena of shape-selective polymerization are discussed by Garwood in ACS Symposium Series No. 218, Intrazeolite Chemistry, "Conversion of $C_2$–$C_{10}$ to Higher Olefins over Synthetic Zeolite ZSM-5", 1983 American Chemical Society.

In the process for catalytic conversion of olefins to heavier hydrocarbons by catalytic oligomerization using an acid crystalline metallosilicate zeolite, such as ZSM-5 or related shape-selective catalyst, process conditions can be varied to favor the formation of either gasoline or distillate range products. In the gasoline operating mode, or MOG reactor system, ethylene and the other lower olefins are catalytically oligomerized at elevated temperature and moderate pressure. Under these conditions ethylene conversion rate is greatly increased and lower olefin oligomerization is nearly complete to produce an olefinic gasoline comprising hexene, heptene, octene and other $C_6$+ hydrocarbons in good yield.

The olefins contained in an FCC gas plant are advantageous feedstock for olefin upgrading. U.S. Pat. No. 4,746,762 (Avidan et al) discloses upgrading olefinic FCC light gas to olefinic gasoline by fluidized bed catalysis. U.S. Pat. Nos. 4,012,455 and 4,090,949 (Owen and Venuto) and published European Patent Application Nos.0,113,180 (Graven and McGovern) disclose integration of olefins upgrading with a FCC plant. In the EPA application the olefin feedstock for oligomerization comprises the discharge stream from the final stage of the wet gas compressor or the overhead from the high pressure receiver which separates the condensed effluent from the final stage wet gas compressor contained in the gas plant. The present invention improves upon such integrated processes by incorporating olefins upgrading advantageously with the FCC gas plant.

SUMMARY OF THE INVENTION

A continuous process has been designed for upgrading a variable throughput light olefinic gas feedstream rich in ethylene and $C_3$–$C_4$ aliphatic hydrocarbons in a fluidized bed catalytic conversion zone. In a prefered embodiment, the process comprises the steps of:

fractionating heavy oil crackate in a main fractionation column to recover distillate range hydrocarbon product, naphtha and light crackate gas;

compressing and cooling the light crackate gas to provide a first pressurized ethene-rich vapor stream and a first condensed crackate stream rich in $C_3$+ aliphatics;

contacting the first ethene-rich stream under pressure with a $C_5$+ liquid sorbent stream in an absorber column under sorption conditions to selectively absorb a major amount of $C_3$+ components and recover a second ethene-rich vapor stream from the absorber column;

contacting said second ethene-rich stream in a fluid bed reactor with a turbulent regime fluidized bed of acid medium pore zeolite oligomerization catalyst particles under oligomerization conditions to produce an olefinic hydrocarbon effluent stream rich in $C_5$+ hydrocarbons;

cooling the reaction effluent stream to provide light gas byproduct and liquid hydrocarbon reaction product;

contacting a first light gas byproduct portion from step (e) with a sponge oil in a secondary sponge absorber to recover liquid hydrocarbons;

recycling a second light byproduct gas portion for maintaining turbulent regime gas velocity in the fluid bed reactor of step (d); and passing sponge oil sorbate liquid from the secondary absorber to the main fractionation column for recovery.

DETAILED DESCRIPTION OF THE INVENTION

Figure 1:
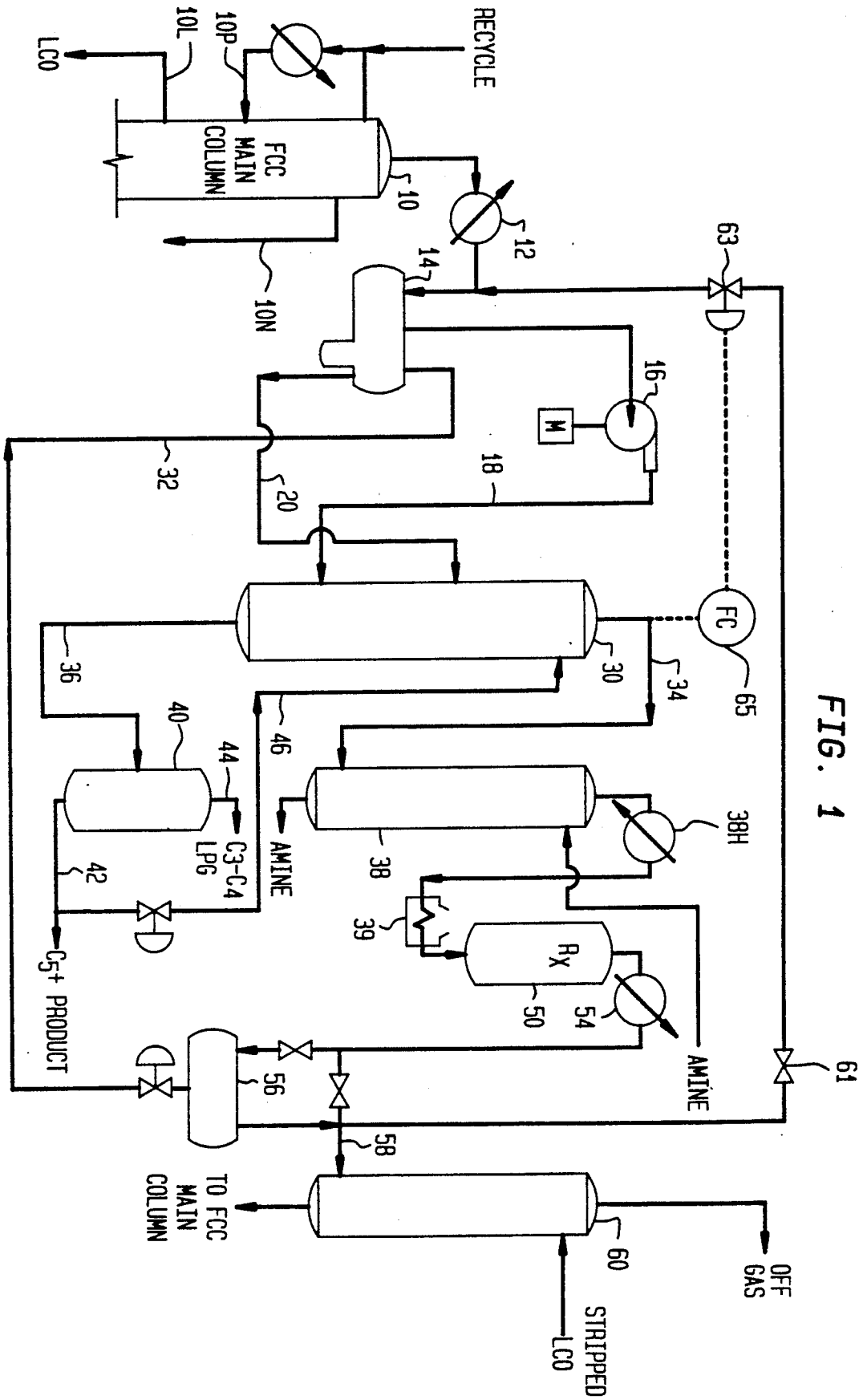
FIG. 1 is a schematic process diagram of a preferred FCC gas plant with an integrated olefins uprgrading unit for fuel gas conversion.

The present invention provides a system for upgrading FCC light olefins to liquid hydrocarbons, utilizing a continuous process for producing fuel products by oligomerizing olefinic components to produce olefinic product for use as fuel or the like. It provides a technique for oligomerizing lower alkene-containing light gas feedstock, optionally containing ethene, propene, butenes or lower alkanes, to produce predominantly $C_5$+ hydrocarbons, including olefins.

The preferred feedstock contains $C_2$–$C_4$ alkenes (mono-olefin), wherein the total $C_3$–$C_4$ alkenes are in the range of about 10 to 50 wt %. Non-deleterious components, such as methane and other paraffins and inert gases, may be present. A particularly useful feedstock is a light gas by-product of FCC gas oil cracking units containing typically 10–40 mol % $C_2$–$C_4$ olefins and 5–35 mol % $H_2$ with varying amounts of $C_1$–$C_3$ paraffins and inert gas, such as $N_2$. The process may be tolerant of a wide range of lower alkanes, from 0 to 95%. Preferred feedstocks contain more than 50 wt. % $C_1$–$C_4$ lower aliphatic hydrocarbons, and contain sufficient olefins to provide total olefinic partial pressure of at least 50 kPa. Under the reaction severity conditions employed in the present invention lower alkanes especially propane, may be partially converted to $C_4$+ products.

Conversion of lower olefins, especially ethene, propene and butenes, over HZSM-5 is effective at moderately elevated temperatures and pressures. The conversion products are sought as liquid fuels, especially the $C_5$+ hydrocarbons. Product distribution for liquid hydrocarbons can be varied by controlling process conditions, such as temperature, pressure and space velocity. Gasoline (eg, $C_5$–$C_9$) is readily formed at elevated temperature (e.g., about 300° to 650° C.) and moderate pressure from ambient to about 5500 kPa, preferably about 250 to 2900 kPa. Under appropriate conditions of catalyst activity, reaction temperature and space velocity, predominantly olefinic and/or aromatic gasoline can be produced in good yield and may be recovered as a product. Operating details for typical olefin oligomerization units are disclosed in U.S. Pat. Nos. 4,456,779; 4,497,968 (Owen et al.) and 4,746,762 (Avidan et al), incorporated herein be reference.

It has been found that $C_2$–$C_4$ rich olefinic light gas can be upgraded to liquid hydrocarbons rich in olefinic gasoline by catalytic conversion in a turbulent fluidized bed of solid acid zeolite catalyst under low severity reaction conditions in a single pass or with recycle of gaseous effluent components. This technique is particularly useful for upgrading LPG and FCC light gas, which usually contains significant amounts of ethene, propene, butenes, $C_2$–$C_4$ paraffins and hydrogen produced in cracking heavy petroleum oils or the like. It is a primary object of the present invention to provide a novel technique for upgrading such lower olefinic feedstock to distillate and gasoline range hydrocarbons in an economic multistage reactor system.

Recent developments in zeolite technology have provided a group of medium pore siliceous materials having similar pore geometry. Most prominent among these intermediate pore size zeolites is ZSM-5, which is usually synthesized with Bronsted acid active sites by incorporating a tetrahedrally coordinated metal, such as Al, Ga, or Fe, within the zeolytic framework. These medium pore shape selective metallosilicate zeolites are favored for acid catalysis; however, the advantages of similar zeolitic materials having the structure of ZSM-5 may be utilized by employing highly siliceous materials or crystalline metallosilicate having one or more tetrahedral species having varying degrees of acidity. ZSM-5 crystalline structure is readily recognized by its X-ray diffraction pattern, which is described in U.S. Pat. No. 3,702,866 (Argauer, et al.), incorporated by reference.

The oligomerization catalyst preferred for use in olefins conversion includes the medium pore (i.e., about 5–7 angstroms) shape selective crystalline aluminosilicate zeolites having a silica to alumina ratio of about 20:1 or greater, a constraint index of about 1–12, and acid cracking activity (alpha value) of about 2–200. Representative of the shape selective zeolites are ZSM-5, ZSM-11, ZSM-12, ZSM-22, ZSM-23, ZSM-35, and ZSM-48. ZSM-5 is disclosed in U.S. Pat. No. 3,702,886 and U.S. Pat. No. Reissue 29,948. Other suitable zeolites are disclosed in U.S. Pat. Nos. 3,709,979 (ZSM-11); 3,832,449 (ZSM-12); 4,076,979; 4,076,842 (ZSM-23); 4,016,245 (ZSM-35); and 4,375,573 (ZMS-48). The disclosures of these patents are incorporated herein by reference.

While suitable zeolites having a silica to coordinated metal oxide molar ratio of 20:1 to 200:1 or higher may be used, it is advantageous to employ a standard ZSM-5 having a silica alumina molar ratio of about 25:1 to 70:1, suitably modified. A typical zeolite catalyst component having Bronsted acid sites may consist essentially of aluminosilicate ZSM-5 zeolite with 5 to 95 wt. % silica clay and/or alumina binder.

These siliceous zeolites may be employed in their acid forms ion exchanged or impregnated with one or more suitable metals, such as Ga, Pd, Zn, Ni, Co and/or other metals of Periodic Groups III to VIII. Ni-exchanged or impregnated catalyst is particularly useful in converting ethene under low severity conditions. The zeolite may include other components, generally one or more metals of group IB, IIB, IIIB, VA, VIA or VIIIA of the Periodic Table (IUPAC). Useful hydrogenation-dehydrogenation components include the noble metals of Group VIIIA, especially platinum, but other noble metals, such as palladium, gold, silver, rhenium or rhodium, may also be used. Base metal hydrogenation components may also be used, especially nickel, cobalt, molybdenum, tungsten, copper or zinc. The catalyst materials may include two or more catalytic components, such as a metallic oligomerization component (eg, ionic $Ni^{+2}$, and a shape-selective medium pore acidic oligomerization catalyst, such as ZSM-5 zeolite) which components may be present in admixture or combined in a unitary bifunctional solid particle. It is possible to utilize an ethene dimerization metal or oligomerization agent to effectively convert feedstock ethene in a continuous reaction zone. Certain of the ZSM-5 type medium pore shape selective catalysts are sometimes known as pentasils. In addition to the preferred aluminosilicates, the borosilicate, ferrosilicate and "silicalite" materials may be employed.

ZSM-5 type pentasil zeolites are particularly useful in the process because of their regenerability, long life and stability under the extreme conditions of operation. Usually the zeolite crystals have a crystal size from about 0.01 to over 2 microns or more, with 0.02–1 micron being preferred.

A further useful catalyst is a medium pore shape selective crystalline aluminosilicate zeolite as described above containing at least one Group VIII metal, for example Ni-ZSM-5. This catalyst has been shown to convert ethylene at moderate temperatures and is disclosed in U.S. Pat. No. 4,717,782 (Garwood et al).

Process and Equipment Description

Process integration can be adapted to employ certain features of an unsaturated gas plant (USGP), especially multistage compression, phase separation, distillation absorption and the operatively connected unit operations essential to recovery of light cracking products or similar aliphatic hydrocarbon streams. The purpose of the gas plant is to maximize liquid recovery. Thus, any $C_3$ and $C_4$ hydrocarbons in the gas plant which are recovered as LPG are more valuable than the $C_1$ and $C_2$ fuel gas. An integrated fluidized bed reactor is maintained in steady state operation under varying fresh feed rates, temperature, pressure and catalyst activity to effect the desired oligomerization of lower olefinic components in the feedstock to gasoline range hydrocarbons.

The embodiment depicted in FIG. 1 provides operating techniques and processing equipment for integrating the light FCC crackate recovery with olefins upgrading in a fluidized bed system. Interstage fractionation may be adapted to utilize conventional petroleum refinery cracking plant equipment in a novel process for upgrading light olefinic crackate gas from hydrocarbon cracking. The FCC main distillation column 10 is equipped with means for withdrawing a naphta stream 10N, a light cycle oil stream 10L, and a pump-around section 10P. The light crackate gas containing ethene propene and other $C_1$–$C_4$ lower aliphatics is passed from the FCC main column 10 via cooler 12 and overhead accumulator 14 to means 16 for compressing and cooling the light crackate gas to provide a first pressurized ethene-rich stream 18 and a first condensed crackate stream 20 rich in $C_3$+ aliphatics.

Absorber tower 30 provides means contacting the first ethene-rich vapor stream under pressure with a $C_5$+ liquid sorbent stream 46 in the absorber column under sorption conditions to selectively absorb a major amount of $C_3$+ components introduced via stream 18 and liquid stream 20, thus recovering a second ethene-rich vapor stream 34 from the absorber de-ethanaizer column. The $C_3$+ liquid bottoms stream 36 may be further fractionated in a debutanizer tower 40 to provide a $C_5$+ liquid gasoline product 42 and LPG product 44. As part of the reactor effluent recovery system, means are provided for cooling and separating the reaction effluent stream to provide a light offgas stream and a condensed liquid hydrocarbon product stream. Advantageously, this is achieved by cooler means 54 and phase separator means 56; however, it may be preferred to flash the reactor effluent via conduit 58 directly into the bottom of vessel 60 to eliminate phase separator 56. In such case the flashed reactor efflent $C_5$+ components are mixed with the rich sponge oil sorbate and passed to the main FCC column for further fractionation. This technique tends to reduce endpoint boiling range of gasoline produced in the oligomerization reactor by separating the components boiling above about 205° C. (400° F.), typically amounts to 3–5% of the gasoline synthesized by olefin upgrading. Recovery of a wild gasoline liquid stream 32 containing normally liquid components and volatile $C_3$–$C_4$ components permits recycle of this stream to provide for fractionating the liquid hydrocarbon product stream in the absorber column concurrently with sorption of the first ethene-rich vapor stream for recovery of liquid hydrocarbon product with the absorber bottoms liquid stream 36 rich in $C_3$+ components.

By further fractionating the absorber bottoms liquid stream to provide a $C_3$–$C_4$ product and a liquid hydrocarbon fraction consisting essentially of $C_5$+ hydrocarbons, and recycling at least a portion of the $C_5$+ liquid hydrocarbon fraction via conduit 46 to the upper stages of absorber column 30 as the liquid sorbent stream absorber efficiency is enhanced. The absorber unit may also utilize volatile naphtha directed under control from FCC drawoff conduit 10N.

The process is particularly useful for fractionating FCC gas oil crackate in an FCC main fractionation column in combination with sponge absorber 60. This is achieved by contacting light offgas stream 58 from accumulator 56 with a sponge oil in the secondary sponge absorber 60 to recover residual heavier hydrocarbons. This can be further integrated by passing sponge oil sorbate liquid from the secondary absorber to the FCC main fractionation column 10 for recovery. Any gasoline range hydrocarbons recovered in sponge oil sorbate liquid can also be taken as product with FCC naphtha via line 10N and 20.

The off gas from the sponge absorber 60 can than be optionally passed to a secondary amine scrubber 70 for further desulfurization and remove any $H_2S$ which might be containined in the sponge oil sorbent stream. Advantageously, a portion of the light gas stream from sponge absorber feed 58 is diverted via conduit 61, and control valve means 63 to be recycled through part of the gas plant during FCC plant turndown operation.

A fluid handling flow control system 65 provides means for measuring flow rate of gas to be introduced below the fluidized bed. This system provides a signal representative of gas flow rate, and provides for controlling addition rate of light byproduct gas via valve 63 to the fresh olefin feedstream to maintain superficial gas velocity in the fluid bed conversion zone at a predetermined minimum rate to prevent slugging or other reactor upset conditions which might adversely affect the process.

It is understood that the point of recombining recycle or measuring the effective total of fresh feed plus recycle can be selected by one skilled in the art to provide a representative control measurement, thereby maintaining turbulent regime operating velocity in the range of 0.2 to 2 meters/second in the fluidized bed under turndown feedstream operation. An alternative control technique may be implemented by running the last stage of a multistage wet gas compressor section at maximum capacity by controlling flow of gaseous recycle. Since the recycle contains unconverted light reactive components, this will optimize olefin conversion in the process.

The process operating technique provides for maintaining in a low severity continuous reaction zone in reactor 50, a fluidized bed of zeolite catalyst particles in a turbulent reactor bed at a temperature of at least about 260° C. To convert feedstock alkenes predominantly to gasoline, hot feedstock vapor can be passed upwardly through the fluidized catalyst bed in a single pass at reaction temperature of about 260°-510° C., preferably at average reactor temperature of 315° C. to 400° C. Temperatures above 600° C. can be employed to produce aromatic hydrocarbons. These reactions can be achieved by maintaining turbulent fluidized bed conditions through the reactor bed at a superficial fluid velocity of about 0.2 to 2 meters per second. The reactor effluent contains a major amount of $C_5$+ hydrocarbons and a minor amount of $C_4$− hydrocarbons, including pentane and pentene in a weight ratio of about 0.04:1 to 7:1. Substantially all $C_4$− light gas components are removed from the reactor effluent stream to provide an intermediate hydrocarboon stream comprising a major amount of intermediate $C_5$+ olefins.

The stream which enters reactor 50 is rich in all of the FCC olefins. A typical composition of this stream is given in Table 1.

TABLE 1

COMPOSITION OF DESULFURIZED DISCHARGE FROM FCC ABSORBER

| Component | Volume % |
|---|---|
| $N_2$ | 11.1 |
| $H_2$ | 19.9 |
| $C_1$ | 33.9 |
| $C_2^=$ | 13.0 |
| $C_2$ | 12.1 |
| $C_3^=$ | 7.5 |
| $C_3$ | 1.9 |
| $iC_4$ | 0.7 |
| $nC_4$ | 0 |
| $C_4^=$ | 0 |

Conditions in the oligomerization reactor can vary within the limits previously described to form liquid hydrocarbon but most preferably will be such so as to maximize production of a gasoline range hydrocarbon liquid.

Fluidized Bed Reactor Operation

Figure 2:
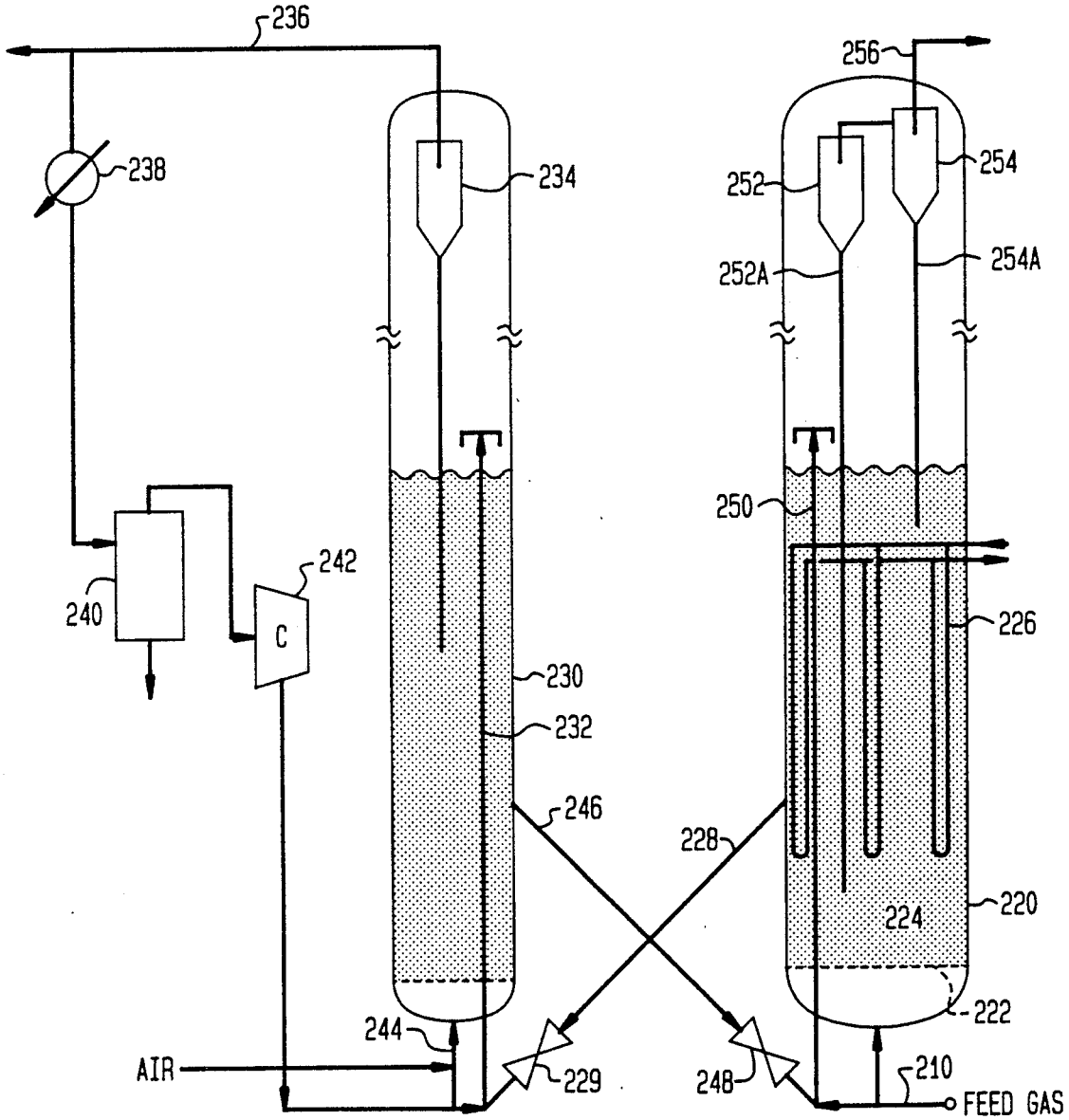
FIG. 2 is a vertical cross-section view of a preferred fluidized bed reactor system according to the present invention.

Referring to FIG. 2 of the drawing, a typical MOG type oligomerization reactor unit is depicted employing a temperature-controlled catalyst zone with indirect heat exchange and/or adjustable gas quench, whereby the reaction heat balance can be carefully controlled. Energy conservation in the system may utilize at least a portion of the reactor effluent heat value by exchanging hot reactor effluent with feedstock and/or recycle streams. Optional heat exchangers may recover heat from the effluent stream prior to fractionation. Whereas olefin oligomerization is exothermic, high temperature conversion of light paraffin components to aromatics is endothermic.

Part of all of the reaction heat can be removed from the reactor without using the indirect heat exchange tubes by using cold feed, whereby reactor temperature can be controlled by adjusting feed temperature. The internal heat exchange tubes can still be used as internal baffles which lower reactor hydraulic diameter, and axial and radial mixing. The use of a fluid-bed reactor offers several advantages over a fixed-bed reactor. Due to continuous catalyst regeneration, fluid-bed reactor operation will not be adversely affected by oxygenate, sulfur and/or nitrogen containing contaminants presented in FCC light gas.

Particle size distribution can be a significant factor in achieving overall homogeneity in turbulent regime fluidization. It is desired to operate the process with particles that will mix well throughout the bed. Large particles having a particle size greater than 250 microns should be avoided, and it is advantageous to employ a particle size range consisting essentially of 1 to 150 microns. Average particle size is usually about 20 to 100 microns, preferably 40 to 80 microns. Particle distribution may be enhanced by having a mixture of larger and smaller particles within the operative range, and it is particularly desirable to have a significant amount of fines. Close control of distribution can be maintained to keep about 10 to 25 wt % of the total catalyst in the reaction zone in the size range less than 32 microns. This class of fluidizable particles is classified as Geldart Group A. Accordingly, the fluidization regime is controlled to assure operation between the transition velocity and transport velocity. Fluidization conditions are substantially different from those found in non-turbulent dense beds or transport beds.

The oligomerization reaction severity conditions can be controlled to optimize yield of $C_5$-$C_9$ aliphatic hydrocarbons. It is understood that aromatic and light paraffin production is promoted by those zeolite catalysts having a high concentration of Bronsted acid reaction sites. Accordingly, an important criterion is selecting and maintaining catalyst inventory to provide either fresh catalyst having acid activity or by controlling catalyst deactivation and regeneration rates to provide an average alpha value of about 2 to 50, based on total catalyst solids.

Reaction temperatures and contact time are also significant factors in determining the reaction severity, and the process parameters are followed to give a substantially steady state condition wherein the reaction severity index (R.I.) is maintained within the limits which yield a desired weight ratio of alkane to alkene produced in the reaction zone. This index may vary from about 0.04 to 7:1, in the substantial absence of $C_3$+ alkanes; but, it is preferred to operate the steady state fluidized bed unit to hold the R.I. at about 0.2 to 5:1. While reaction severity is advantageously determined by the weight ratio of propane:propene ($R.I._3$) in the gaseous phase, it may also be measured by the analogous ratios of butanes:butenes, pentanes:pentenes ($R.I._5$), or the average of total reactor effluent alkanes:alkenes in the $C_3$-$C_5$ range. Accordingly, the product $C_5$ ratio may be a preferred measure of reaction severity conditions, especially with mixed aliphatic feedstock containing $C_3$-$C_4$ alkanes.

This technique is particularly useful for operation with a fluidized catalytic cracking (FCC) unit to increase overall production of liquid product in fuel gas limited petroleum refineries. Light olefins and some of the light paraffins, such as those in FCC light gas, can be converted to valuable $C_5$+ hydrocarbon product in a fluid-bed reactor containing a zeolite catalyst. In addition to $C_2$-$C_4$ olefin upgrading, the load to the refinery fuel gas plant is decreased considerably.

The use of fluidized bed catalysis permits the conversion system to be operated at low pressure drop. Another important advantage is the close temperature control that is made possible by turbulent regime operation, wherein the uniformity of conversion temperature can be maintained within close tolerances, often less than 10° C. Except for a small zone adjacent the bottom gas inlet, the midpoint measurement is representative of the entire bed, due to the thorough mixing achieved.

In a typical process, the olefinic feedstock is converted in a catalytic reactor under oligomerization conditions and moderate pressure (i.e. −400 to 2500 kPa) to produce a predominantly liquid product consisting essentially of $C_5$+ hydrocarbons rich in gasoline-range olefins and essentially free of aromatics.

Referring now to FIG. 2, feed gas rich in lower olefins passes under pressure through conduit 210, with the main flow being directed through the bottom inlet of reactor vessel 220 for distribution through grid plate 222 into the fluidization zone 224. Here the feed gas contacts the turbulent bed of finely divided catalyst particles. Reactor vessel 210 is shown provided with heat exchange tubes 226, which may be arranged as several separate heat exchange tube bundles so that temperature control can be separately exercised over different portions of the fluid catalyst bed. The bottoms of the tubes are spaced above feed distributor grid 222 sufficiently to be free of jet action by the charged feed through the small diameter holes in the grid. Alternatively, reaction heat can be partially or completely removed by using cold feed. Baffles may be added to control radial and axial mixing. Although depicted without baffles, the vertical reaction zone can contain open end tubes above the grid for maintaining hydraulic constraints, as disclosed in U.S. Pat. No. 4,251,484 (Daviduk and Haddad). Heat released from the reaction can be controlled by adjusting feed temperature in a known manner.

Catalyst outlet means 228 is provided for withdrawing catalyst from above bed 224 and passed for catalyst regeneration in vessel 230 via control valve 229. The partially deactivated catalyst is oxididatively regenerated by controlled contact with air or other regeneration gas at elevated temperature in a fluidized regeneration zone to remove carbonaceous deposits and estore acid acitivity. The catalyst particles are entrained in a lift gas and transported via riser tube 232 to a top portion of vessel 230. Air is distributed at the bottom of the bed to effect fluidization, with oxidation byproducts being carried out of the regeneration zone through cyclone separator 234, which returns any entrained solids to the bed. Flue gas is withdrawn via top conduit 236 for disposal; however, a portion of the flue gas may be recirculated via heat exchanger 238, separator 240, and compressor 242 for return to the vessel with fresh oxidation gas via line 244 and as lift gas for the catalyst in riser 232.

Regenerated catalyst is passed to the main reactor 220 through conduit 246 provided with flow control valve 248. The regenerated catalyst may be lifted to the catalyst bed with pressurized feed gas through catalyst return riser conduit 250. Since the amount of regenerated catalyst passed to the reactor is relatively small, the temperature of the regenerated catalyst does not upset the temperature constraints of the reactor operations in significant amount. A series of sequentially connected cyclone separators 252, 254 are provided with diplegs 252A, 254A to return any entrained catalyst fines to the lower bed. These separators are positioned in an upper portion of the reactor vessel comprising dispersed catalyst phase 224. Filters, such as sintered metal plate filters, can be used alone or in conjunction with cyclones.

The product effluent separated from catalyst particles in the cyclone separating system is then withdrawn from the reactor vessel 220 through top gas outlet means 256.

The recovered hydrocarbon product comprising $C_5$+ olefins and/or aromatics, paraffins and naphtenes is thereafter processed as required to provide a desired gasoline or higher boiling product.

Under optimized process conditions the turbulent bed has a superficial vapor velocity of about 0.2 to 2 meters per second (m/sec). At higher velocities entrainment of fine particles may become excessive and beyond about 3 m/sec the entire bed may be transported out of the reaction zone. At lower velocities, the formation of large bubbles or gas voids can be detrimental to conversion. Even fine particles cannot be maintained effectively in a turbulent bed below about 0.1 m/sec.

A convenient measure of turbulent fluidization is the bed density. A typical turbulent bed has an operating density of about 100 to 500 kg/m$^3$, preferrably about 300 to 500 kg/m$^3$, measured at the bottom of the reaction zone, becoming less dense toward the top of the reaction zone, due to pressure drop and particle size differentiation. The weight hourly space velocity and uniform contact provides a close control of contact time between vapor and solid phases, typically about 3 to 15 seconds.

Several useful parameters contribute to fluidization in the turbulent regime in accordance with the process of the present invention. When employing a ZSM-5 type zeolite catalyst in fine powder form such a catalyst should comprise the zeolite suitably bound or impregnated on a suitable support with a solid density (weight of a representative individual particle divided by its apparent "outside" volume) in the range from 0.6–2 g/cc, preferably 0.9–1.6 g/cc. The catalyst particles can be in a wide range of particle sizes up to about 250 microns, with an average particle size between about 20 and 100 microns, preferably in the range of 10–150 microns and with the average particle size between 40 and 80 microns. When these solid particles are placed in a fluidized bed where the superficial luid velocity is 0.3–2, operation in the turbulent regime is obtained. The velocity specified here is for an operation at a total reactor pressure of about 400 to 2500 kPa. Those skilled in the art will appreciate that at higher pressures, a lower gas velocity may be employed to ensure operation in the turbulent fluidization regime. The reactor can assume any technically feasible configuration, but several important criteria should be considered. The bed of catalyst in the reactor can be at least about 5–20 meters in height, preferably about 9–10 meters.

The following example tabulates typical FCC light gas oligomerization reactor feed and effluent compositions and shows process conditions for a particular case in which the reactor temperature is controlled at 400° C. The reactor may be heat balanced by controlled preheating the feed to about 135° C. The preferred catalyst is H-ZSM-5 (25 wt %) with particle distribution as described above for turbulent bed operation.

TABLE 2

| Composition, wt. % | Gas Feed | Effluent |
|---|---|---|
| $H_2$ | 0.9 | 0.9 |
| $C_1$ | 18.7 | 18.7 |
| $C_3$ | 17.2 | 17.5 |
| $C_2$= | 15.4 | 2.1 |
| $C_3$ | 6.5 | 9.2 |
| $C_3$= | 16.5 | 1.8 |

TABLE 2-continued

| | | |
|---|---|---|
| $iC_4$ | 3.8 | 7.9 |
| $nC_4$ | 0.8 | 2.7 |
| $C_4^=$ | 3.9 | 3.1 |
| $C_5+$ | 3.8 | 23.6 |
| $N_2$ | 10.3 | 10.3 |
| CO | 2.2 | 2.2 |
| | 100 | 100 |

| Reactor Conditions | |
|---|---|
| Temperature, °C. | 100 |
| Pressure | 1200 kPa |
| Olefin WHSV (based on total cat. wt.) | 0.4 |

While the invention has been shown by describing preferred embodiments of the process, there is no intent to limit the inventive concept, except as set forth in the following claims.

We claim:

1. A process for upgrading light olefinic crackate gas from hydrocarbon cracking, said light crackate gas containing ethene, propene and other $C_1$–$C_4$ lower aliphatics, comprising the steps of:

(a) fractionating heavy oil crackate in a main fractionation column to recover distillate range hydrocarbon product, naphtha and light crackate gas;

(b) compressing and cooling the light crackate gas to provide a first pressurized ethene-rich vapor stream and a first condensed crackate stream rich in $C_3+$ aliphatics;

(c) contacting the first ethene-rich vapor stream under pressure with a $C_5+$ liquid sorbent stream in an absorber column under sorption conditions to selectively absorb a major amount of $C_3+$ components and recover a second ethene-rich vapor stream from the absorber column;

(d) contacting said second ethene-rich vapor stream in a fluid bed reactor with a turbulent regime fluidized bed of acid medium pore zeolite oligomerization catalyst particles under oligomerization conditions to produce a hydrocarbon effluent stream rich in $C_5+$ hydrocarbons;

(e) cooling the reaction effluent stream to provide light gas byproduct and liquid hydrocarbon reaction product;

(f) contacting a first light gas byproduct portion from step (e) with a sponge oil in a secondary sponge absorber to recover liquid hydrocarbons;

(g) recycling a second light byproduct gas portion for maintaining turbulent regime gas velocity in the fluid bed reactor of step (d); and (h) passing sponge oil sorbate liquid from the secondary absorber to the main fractionation column for recovery.

2. The process of claim 1 wherein a condensed liquid hydrocarbon stream from step (e) contains volatile components and passes into the absorber column at an upper portion thereof to be stabilized and provide sorbent liquid.

3. The process of claim 1 wherein the light olefinic crackate gas contains a minor amount of $H_2S$, and including the step of contacting the absorber overhead vapor stream with liquid amine to remove $H_2S$ prior to contacting reaction catalyst; and wherein lean sponge oil liquid containing $H_2S$ is stripped free of $H_2S$ prior to contact with light gas in step (f).

4. The process of claim 1 wherein fluidized oligomerization catalyst has an apparent particle density of about 0.9 to 1.6 g/cm$^3$ and a size range of about 1 to 150 microns, average catalyst particle size of about 20 to 100 microns, and containing about 10 to 25 weight percent of fine particles having a particle size less than 32 microns.

5. The process of claim 4 wherein the oligomerization catalyst has an acid cracking value of about 2 to 50, based on total reactor fluidized catalyst weight.

6. The process of claim 1 including the step of maintaining turbulent fluidized bed conditions through the reactor bed by passing fresh ethene-rich gas from step (b) upwardly through the fluidized catalyst bed and adding thereto sufficient recycled light gas from step (g) to maintain a superficial fluid velocity of about 0.2 to 2 meters per second.

7. The process of claim 1 wherein said light crackate gas comprises at least 5 mole % ethylene.

8. The process of claim 1 comprising the steps of maintaining an oligomerization reactor containing a fluidized bed of zeolite catalyst particles in a low severity reactor bed at oligomerization temperature of about 260° to 650° C.;

passing hot olefinic crackate gas upwardly through the fluidized catalyst bed under normal design capacity throughput rate conditions sufficient to convert at least 50 wt % of lower olefins to heavier hydrocarbons in the $C_5$–$C_{10}$ range.

9. The process of claim 1 comprising the further step of withdrawing a portion of coked catalyst from the fluidized bed reactor, oxidatively regenerating the withdrawn catalyst and returning regenerated catalyst to the fluidized bed reactor at a rate to control catalyst activity whereby $C_3$–$C_5$ alkane:alkene weight ratio in the hydrocarbon product is maintained at about 0.04:1 to 7:1 under conditions of reaction severity to effect feedstock conversion.

10. The process of claim 1 wherein the oligomerization catalyst consists essentially of a medium pore pentasil zeolite having an acid cracking value of about 0.1 to 20 and average particle size of about 20 to 100 microns; fluidized bed reactor catalyst inventory includes at least 10 weight percent fine particles having a particle size less than 32 microns; and wherein said catalyst particles comprise about 5 to 95 weight percent acid metallosilicate zeolite having the structure of ZSM-5 and having a crystal size of about 0.02–2 microns.

11. A continuous process for upgrading a variable throughput light olefinic gas feedstream rich in ethylene and $C_3$–$C_4$ aliphatic hydrocarbons in a fluidized bed catalytic conversion zone, comprising the steps of:

maintaining an oligomerization reactor containing a fluidized bed of zeolite catalyst particles in a low severity reactor bed at oligomerization temperature conditions by passing hot olefinic gas upwardly through the fluidized catalyst bed under throughput rate conditions sufficient to convert at least 50 wt % of lower olefins to hydrocarbons in the $C_5$–$C_{10}$ range;

maintaining turbulent fluidized bed conditions through the fluidized bed by passing fresh ethene-rich feedstream gas upwardly through the fluidized catalyst bed and adding thereto sufficient recycled light byproduct gas to maintain a superficial gas velocity of about 0.3 to 2 meters per second.

cooling reaction effluent from the conversion zone to provide light gas byproduct and liquid hydrocarbon reaction product rich in $C_5$–$C_9$ hydrocarbons;

recycling sufficient light byproduct gas recovered from effluent for maintaining turbulent regime gas velocity in the fluidized bed.

12. The process of claim 11 including the steps of measuring flow rate of gas introduced below the fluidized bed, providing a signal representative of said gas flow rate, controlling addition rate of light byproduct gas to the fresh olefin feedstream to maintain superficial gas velocity at a predetermined rate in the range of 0.2 to 3 meters/second, thereby maintaining turbulent regime operating conditions in the fluidized bed under turndown feedstream operation.

13. A process for upgrading light olefinic crackate gas from hydrocarbon cracking, said light crackate gas containing ethene, propene and other $C_1$–$C_4$ lower aliphatics, comprising the steps of:

(a) fractionating heavy oil crackate in a main fractionation column to recover distillate range hydrocarbon product, naphtha and light crackate gas;

(b) compressing and cooling the light crackate gas to provide a first pressurized ethene-rich vapor stream and a first condensed crackate stream rich in $C_3$+ aliphatics;

(c) contacting the first ethene-rich vapor stream under pressure with a $C_5$+ liquid sorbent stream in an absorber column under sorption conditions to selectively absorb a major amount of $C_3$+ components and recover a second ethene-rich vapor stream from the absorber column;

(d) contacting said second ethene-rich vapor stream in a fluid bed reactor with a turbulent regime fluidized bed of acid medium pore zeolite oligomerization catalyst particles under oligomerization conditions to produce a hydrocarbon effluent stream rich in $C_5$+ hydrocarbons;

(e) cooling the reaction effluent stream to provide light gas byproduct and liquid hydrocarbon reaction product;

(f) contacting a first light gas byproduct portion from step (e) with a sponge oil in a secondary sponge absorber having a bottom portion operatively connected to receive reaction effluent for recovery of liquid hydrocarbons;

(g) recycling a second light byproduct gas portion in an amount sufficient to maintain turbulent regime gas velocity in the fluid bed reactor of step (d);

(h) passing sponge oil sorbate liquid from the secondary absorber to the main fractionation column for recovery;

(i) flashing substantially the entire cooled reaction effluent stream from step (e) into the bottom section of the secondary sponge absorber; and (j) passing liquid reaction product from step (e) with sponge oil liquid to the main fractionation column separation step (a) for recovery therein.

* * * * *